United States Patent [19]

Allison

[11] 4,076,348

[45] Feb. 28, 1978

[54] ARTIST'S KIT

[75] Inventor: Harvey W. Allison, Oakley, Kans.

[73] Assignee: The Raymond Lee Organization, Inc., New York, N.Y. ; a part interest

[21] Appl. No.: 783,295

[22] Filed: Mar. 31, 1977

[51] Int. Cl.[2] ..... A47B 97/08; A47B 27/00

[52] U.S. Cl. ..... 312/231; 312/233; 312/244; 248/461

[58] Field of Search ..... 312/231, 233, 244, 230, 312/235 A; 248/461, 499

[56] References Cited

U.S. PATENT DOCUMENTS

| | | | |
|---|---|---|---|
| 654,841 | 7/1900 | MacDonald | 312/231 |
| 2,667,392 | 1/1954 | Sexton | 312/244 |
| 3,168,363 | 2/1965 | Monsour | 312/231 |
| 3,202,471 | 8/1965 | Wilson | 248/461 |
| 3,476,456 | 11/1969 | Canavan | 312/244 |

FOREIGN PATENT DOCUMENTS

| | | | |
|---|---|---|---|
| 1,363,532 | 5/1964 | France | 248/461 |

*Primary Examiner*—Paul R. Gilliam
*Assistant Examiner*—Victor N. Sakran
*Attorney, Agent, or Firm*—Daniel Jay Tick

[57] ABSTRACT

A bench member has spaced opposite first and second ends, a top and a bottom. A first pair of legs are foldably mounted on the bench member at the bottom of the first end thereof. A first guide device is affixed to the first pair of legs for removably supporting a palette between the first pair of legs. A second pair of legs are foldably mounted on the bench member at the bottom of the second end thereof. A second guide device is affixed to the second pair of legs for removably supporting a canvas therebetween. A storage box is pivotally affixed at a pair of corners of the box to the bench at the top of the second end of the bench. The storage box is for paints, brushes and supplies, and has a lid movably affixed to the box for selectively covering the box. Canvas supporting devices are provided on the inside surface of the lid for releasably mounting a canvas thereon whereby the lid functions as an easel.

2 Claims, 6 Drawing Figures

ARTIST'S KIT

BACKGROUND OF THE INVENTION

The present invention relates to an artist's kit.

Objects of the invention are to provide an artist's kit of simple structure, which is inexpensive in manufacture, light in weight, readily foldable to a compact shape which is carried with comfort and convenience, and readily assembled with facility and convenience to provide everything required by an artist for preparing a painting, or the like, including a bench, a palette, canvas, an easel, and storage box for paints, brushes and supplies.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
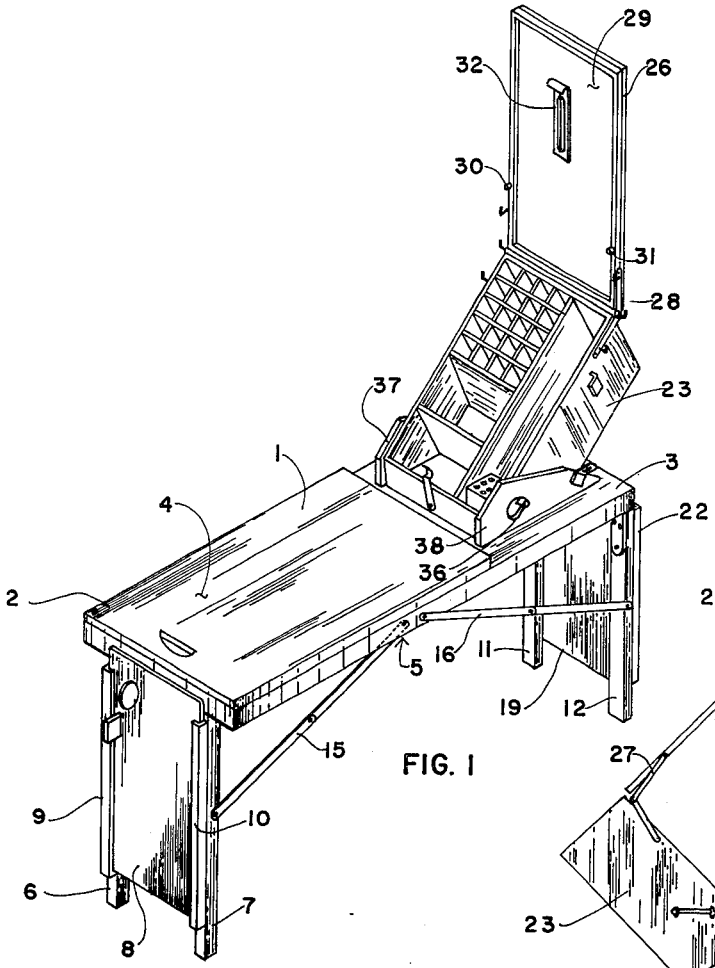
FIG. 1 is a perspective view of an embodiment of the artist's kit of the invention in assembled condition.
Figure 2:
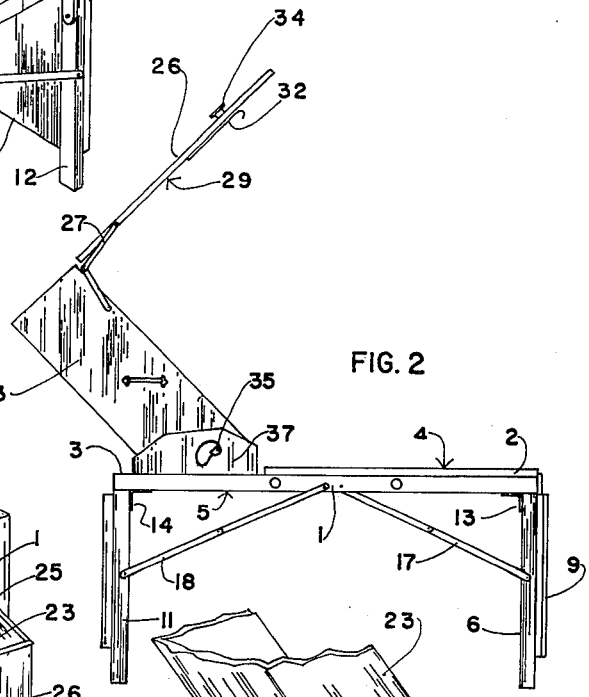
FIG. 2 is a side view of the embodiment of FIG. 1, in assembled condition, taken along the lines II—II, of FIG. 1.

The artist's kit of the invention comprises a bench member 1 (FIGS. 1 to 4) having spaced opposite first and second ends 2 and 3 (FIGS. 1 and 2), a top 4 (FIGS. 1 and 3) and a bottom 5 (FIGS. 1 and 2).

Figure 3:
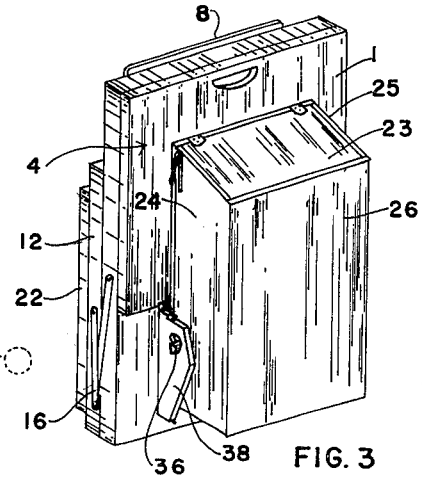
FIG. 3 is a perspective view of the embodiment of FIG. 1 in folded condition.
Figure 6:
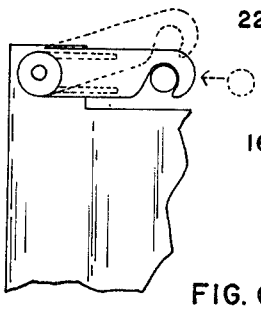
FIG. 6 is a view, on an enlarged scale, of a fastening device utilized with the artist's kit of the invention.

A first pair of legs 6 and 7 (FIG. 1) are foldably mounted on the bench member 1 at the bottom 5 of the first end 2 thereof. The legs 6 and 7 fold into, and flush with, the seat structure, as shown at the top of FIG. 3.

A first guide device is affixed to the first pair of legs 6 and 7 for removably supporting a palette 8 (FIG. 1) between said first pair of legs. The first guide device comprises a first pair of channel members 9 and 10 affixed to the legs 6 and 7, respectively, for providing a storage channel alongside each of said legs for removably supporting the palette 8. A friction spring is provided in the leg 7 to prevent the palette from accidentally sliding out of position. There is enough space behind the palette to permit it to be stored without being cleaned and thereby avoid smearing paint on it.

A second pair of legs 11 and 12 (FIGS. 1 and 4) are foldably mounted on the bench member 1 at the bottom 5 of the second end 2 thereof. The legs 9, 10, 11 and 12 are foldably mounted on the bench 1 by any suitable means such as, for example hinges, of which hinges 13 and 14 affixing the legs 6 and 11 to the bottom 5 of said bench are shown in FIG. 2, and foldable struts, of which struts 15 and 16 extending between the legs 7 and 12 and the bottom 5 of the bench member 1 are shown in FIG. 1, and struts 17 and 18 extending between the legs 6 and 11 and the bottom of said bench member are shown in FIG. 2. The struts are bent over on themselves when the legs are folded to close proximity with the bottom of the bench member 1 and are maintained in stiff supporting condition when the legs support the bench member.

A second guide device is affixed to the second pair of legs 11 and 12 for removably supporting a canvas 19 (FIGS. 1 and 4) therebetween. The second guide device comprises a spring-biased substantially T-shaped member having a stem part 20 and a head part 21, urged against the legs 11 and 12 by the action of the spring. This provided a gentle clamping force which is sufficient to hold a canvas bearing paint in a secure, non-smudging position. The spring is housed in a channel member 22 affixed to, and extending along the length of, the leg 12, as shown in FIGS. 1 and 4.

Figure 4:
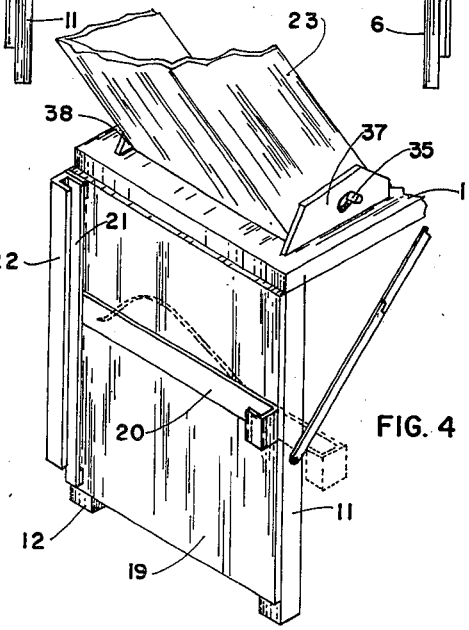
FIG. 4 is a perspective view, on an enlarged scale, of part of the embodiment of FIG. 1.

A storage box 23 (FIGS. 1 to 4) is pivotally affixed at a pair of corners 24 and 25 (FIG. 3) of the box, to the bench member 1 at the top 4 of the second end 3 of said bench member, as shown in FIGS. 1, 2 and 4. The storage box 23 is for paints, brushes and supplies and anything required by a working artist in the field.

Figure 5:
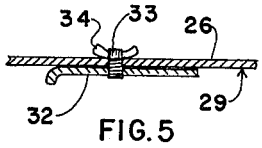
FIG. 5 is a cross-sectional view, on an enlarged scale, of the adjustment member on the inside of the lid of the storage box.

The storage box 23 has a lid 26 (FIGS. 1 to 3 and 5) movably affixed to the box via any suitable means such as, for example, hinges and struts 27 (FIG. 2) and 28 (FIG. 1) for selectively covering the box. The struts 27 and 28 utilized for mounting the lid are high friction struts which remain in any selected position until a heavy manual force is applied to them to move them in another desired position. This permits secure positioning of the lid relative to the bench member 1. The lid 26 has an inside surface 29 (FIGS. 1, 2 and 5). The struts 27 and 28 are high strength steel and are designed to hold the hinged lid 26 in a predetermined and fixed position, in relation to the paint box and the seat member.

Canvas supporting devices are provided on the inside surface 29 of the lid 26 of the storage box 23 for releasably mounting a canvas thereon whereby the lid functions as an easel. The canvas supporting devices comprise a pair of canvas holding devices 30 and 31 such as, for example, clamps, pins, or the like, as shown in FIG. 1, and an adjustment member 32 adjustably mounted thereon (FIGS. 1, 2 and 5). The adjustment member 32 serves to clamp the upper part of the canvas and is secured in position via a bolt 33 (FIG. 5) extending through a slot formed through the lid 26 and a wing nut 34 affixed to said bolt on the side of the lid from said adjustment member, as shown in FIGS. 2 and 5. The canvas supporting devices consist of three lugs on each lid supporting strut. The lugs are integrally formed with the struts and extend therefrom. The canvas is placed in the lugs, which support it in the desired position, in accordance with the size of the canvas. The upper part of the canvas is held by the adjustment member 32, as stated.

The box 23 is releasably secured to the bench member 1 at a selected angle with the top 4 of said bench member, via a box positioning device 35, 36 (FIGS. 4 and 1). The box positioning device 35, 36 maintains the box 23 at a selected angle relative to the top 4 of the bench member 1. The box positioning device may comprise any suitable means for accomplishing this such as, for example, a plurality of semicylindrical grooves formed in a semicircle in each of a pair of mounting plates 37 and 38 (FIGS. 1 and 4) and a pair of pins extending from the box and selectively positioned in desired ones of such grooves. The mounting plates 37 and 38 are affixed to the top of the bench member 1.

The paint box 23 is openable to only one position, in which it rests on the bench member, as shown in FIG.

1. When the box is closed, it is secured by a tool kit type fastener.

The brush holder comprises a block hinged to the sides of the compartment in which it is placed by friction type center hinges. The block has tapered bores formed therein for supporting brushes of various sizes in substantially vertical position for immediate use or for storage within the box when they are not in use. The brushes may be placed in the holder, where they cannot touch each other or the sides of the box, so they need not be cleaned if they are to be used in the near future. This is an excellent advantage when several colors are used in one sitting, or when a move to another location is anticipated.

An artist transports the assembled kit with facility and convenience and assembles it at a desired location. Then he seats himself on the bench member 1 and adjusts the box 23 relative to said bench member and the lid 26 relative to said box so that he may utilize said lid as an easel. The artist sits astraddle the bench member 1, facing the second end 3 thereof. Prior to seating himself, he removes the palette 8 from its position between the legs 6 and 7 and mounts a canvas on the inside surface 29 of the lid 26 and secures same in a position desired via the canvas holding devices 30, 31 and 32.

When the palette 8 is removed for use, it may be placed in the handle loop on the side of the paint box for use as a table for mixing paints. The palette may be left in this position, or manually held, while painting, at the discretion of the artist.

While the invention has been described by means of a specific example and in a specific embodiment, I do not wish to be limited thereto, for obvious modifications will occur to those skilled in the art without departing from the spirit and scope of the invention.

I claim:

1. An artist's kit, comprising a bench member having spaced opposite first and second ends, a top and a bottom;

a first pair of legs foldably mounted on the bench member at the bottom of the first end thereof;

first guide means affixed to the first pair of legs for removably supporting a palette between said first pair of legs;

a second pair of legs foldably mounted on the bench member at the bottom of the second end thereof;

second guide means affixed to the second pair of legs for removably supporting a canvas therebetween;

a storage box pivotally affixed at a pair of corners of the box to the bench at the top of the second end of said bench, said storage box being for paints, brushes and supplies, and having a lid movably affixed to the box for selectively covering the box, said lid having an inside surface; and canvas supporting means on the inside surface of the lid of the storage box for releasably mounting a canvas thereon whereby said lid functions as an easel.

2. An artist's kit as claimed in claim 1, further comprising box positioning means for releasably securing the storage box at a selected angle with the top of the bench member and lid positioning means for releasably securing the lid at a selected angle with the box whereby the lid is utilizable as an easel to an artist seated on the bench member astraddle and facing the second end thereof.

* * * * *